US007473164B2

(12) United States Patent
Sunnen

(10) Patent No.: US 7,473,164 B2
(45) Date of Patent: Jan. 6, 2009

(54) SELF-CENTERING SKATE HOLDER

(76) Inventor: August Sunnen, 280 Grand Avenue East, Chatham, Ontario (CA) N7M 5L5

( * ) Notice: Subject to any disclaimer, the term of this patent is extended or adjusted under 35 U.S.C. 154(b) by 767 days.

(21) Appl. No.: 11/012,484

(22) Filed: Dec. 16, 2004

(65) Prior Publication Data

US 2006/0121838 A1 Jun. 8, 2006

Related U.S. Application Data

(63) Continuation-in-part of application No. 10/735,896, filed on Dec. 16, 2003, now abandoned.

(51) Int. Cl.
*B24B 7/00* (2006.01)

(52) U.S. Cl. ..... 451/234; 451/383; 269/196; 269/217; 269/236

(58) Field of Classification Search ..... 451/383, 451/234, 45, 371; 269/2, 196, 197, 199, 269/217, 236
See application file for complete search history.

(56) References Cited

U.S. PATENT DOCUMENTS 3,597,880 A 8/1971 Norgiel
3,988,865 A * 11/1976 Weisman ..... 451/383
4,055,026 A 10/1977 Zwicker
4,078,337 A 3/1978 Chiasson et al.
4,094,101 A 6/1978 Robinson
5,547,416 A 8/1996 Timms
5,897,428 A 4/1999 Sakcriska
6,206,354 B1 3/2001 Lin
6,412,158 B1 7/2002 Moore
6,422,934 B1 7/2002 Blach et al.
6,431,535 B1 8/2002 Volpe

FOREIGN PATENT DOCUMENTS

CA 1118514 2/1982
CA 2023121 2/1996

* cited by examiner

*Primary Examiner*—Eileen P. Morgan
(74) *Attorney, Agent, or Firm*—John R. S. Orange; Brett J. Slaney; Blake, Cassels & Graydon LLP

(57) ABSTRACT

A self-centering skate holder for clamping a skate blade from above and below which maintains the blade at a predetermined height and parallelism. A handle is connected with a cable which is taut and extends around the circumference of the upstanding vertical member. The movements of the cable activate cam levers which rotate cams that move a pair of jaws towards or away from each other. The simultaneous movements of the cams ensure that the jaws move in unison and through a similar distance allowing a skate blade of any thickness to be clamped along the desired centerline. In an alternative mechanism, a tie bar extends between the jaws and is operated by a cam to induce equal and opposite movement of the jaws.

13 Claims, 13 Drawing Sheets

SELF-CENTERING SKATE HOLDER

This application is a continuation-in-part of U.S. patent application Ser. No. 10/735,896 filed on Dec. 16, 2003 now abandoned.

FIELD OF THE INVENTION

The present invention relates to skate holders for use with skate sharpening machines.

DESCRIPTION OF THE PRIOR ART

Skates used in activities such as hockey, figure skating, speed skating and for leisure include a boot and a blade. The blade is attached to the bottom of the boot and is used to 'dig into' an ice surface allowing the skater to glide along the ice due to the opposing force imparted on the skater when pushing against the ice surface. To effectively grip the ice surface, the blade includes a concave surface at its lowermost edge. This concave surface, commonly known as a 'hollow ground', produces two parallel edges opposed about the centreline of the hollow ground. Through repeated contact with the ice surface, the edges are worn down due to friction with the ice surface and periodically need to be sharpened.

Sharpening a skate blade involves restoring the sharp edges of the skate blade by bringing the dull edges into engagement with the convex radius of the face of a grinding wheel and applying pressure. This allows the grinding wheel to grind the blade in a manner that restores the previously achieved sharp edges with two parallel edges. A proper sharpening requires that the centreline of the hollow grind be in a similar plane as the centreline of the convex radius of the grinding wheel. This is achieved by maintaining the skate blade in the proper orientation and at the proper height.

Typically, a skate sharpening grinding wheel is horizontally oriented so that its axis of rotation is perpendicular to the table on which it is mounted. With the grinding wheel parallel to the table, the skate blade must be held with its outwardly facing edges parallel to the grinding table and the concave surface of the blade held at an identical level as the convex radius of the grinding wheel. To maintain this orientation, a holder is required which typically includes a clamping mechanism to maintain the skate in the proper position for the duration of the sharpening procedure.

A skate holder with a clamping mechanism is shown in a U.S. Pat. No. 4,078,337 to Chiasson et al. The skate blade is placed with one outwardly facing surface against a stationary jaw. The opposing jaw is lowered against the other outwardly facing surface and tightened to secure the skate in place. The stationary jaw is positioned so that a particular blade in the proper alignment with the convex radius of the grinding wheel. By securing the skate blade between a clamping jaw and a stationary jaw, any blade that is clamped would be held at a similar level. Since the thickness of a skate blade may vary between different skate models and different skate types, this type of clamping mechanism does not ensure that the centrelines of the hollow ground and convex outer radius of the grinding wheel are aligned properly. A misaligned blade will of course impart an uneven sharpening due to the off-center grinding from the grinding wheel.

To ensure the centrelines of the hollow grind and convex outer radius of the grinding wheel are properly aligned, self-centering skate holders have been developed. To achieve self-centering, the clamping mechanism allows both jaws to approach the blade from their respective sides. By moving identical distances during the clamping operation, no matter the thickness of the blade, the centerline will be properly aligned. A self-centering skate holder is shown in a U.S. Pat. No. 4,055,026 to Zwicker and similarly a U.S. Pat. No. 6,422,934 to Blach et al. The clamping arms in these designs are pivoted about an axis located a distance behind the point of clamping and consequently behind the boot and the blade. This arrangement creates a large area for the skate to be placed. While this design achieves self-centering, the location of the pivot axis renders a large and bulky apparatus. To achieve a proficient sharpening, it is beneficial for the user to have full control of the skate holder. The user must guide the holder towards the grinding wheel, therefore a large and bulky design is not desired.

It is therefore an object of the present invention to obviate or mitigate at least one of the above mentioned disadvantages.

SUMMARY OF THE INVENTION

In one aspect a self-centering skate holder is provided comprising a base, a mounting plate secured to said base and having an elongated slot therein to receive a blade of a skate, a pair of jaws located on said mounting plate on opposite sides of said slot and moveable relative to one another to engage opposite sides of said blades, and an operating mechanism connected to each of said jaws and operable to move said jaws conjointly from an open position to a closed position whereby said jaws remain equally spaced to opposite sides of a datum during such movement.

Preferably the operating mechanism is supported on the plate and includes a flexible tensile member to transfer movement of one jaw to the other.

BRIEF DESCRIPTION OF THE DRAWINGS

These and other features of the preferred embodiments of the invention will become more apparent in the following detailed description in which reference is made to the appended drawings wherein:

FIG. 8 is a partial view of the upper and lower clamping jaws moving between open end closed positions with a skate blade disposed between.

DESCRIPTION OF THE PREFERRED EMBODIMENTS

Figure 1:
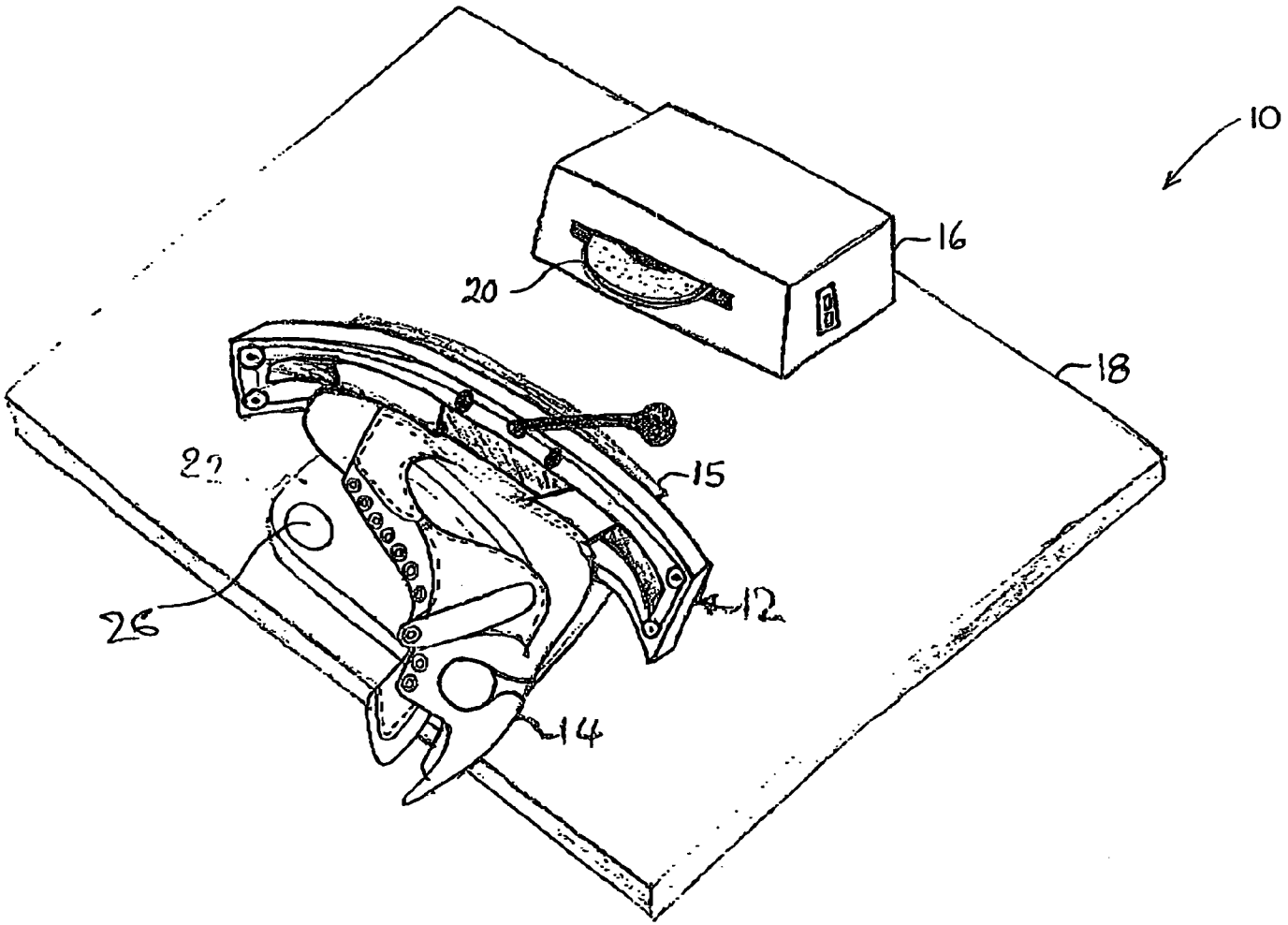
FIG. 1 is a perspective view of a skate sharpener and skate holder.
Figure 2:
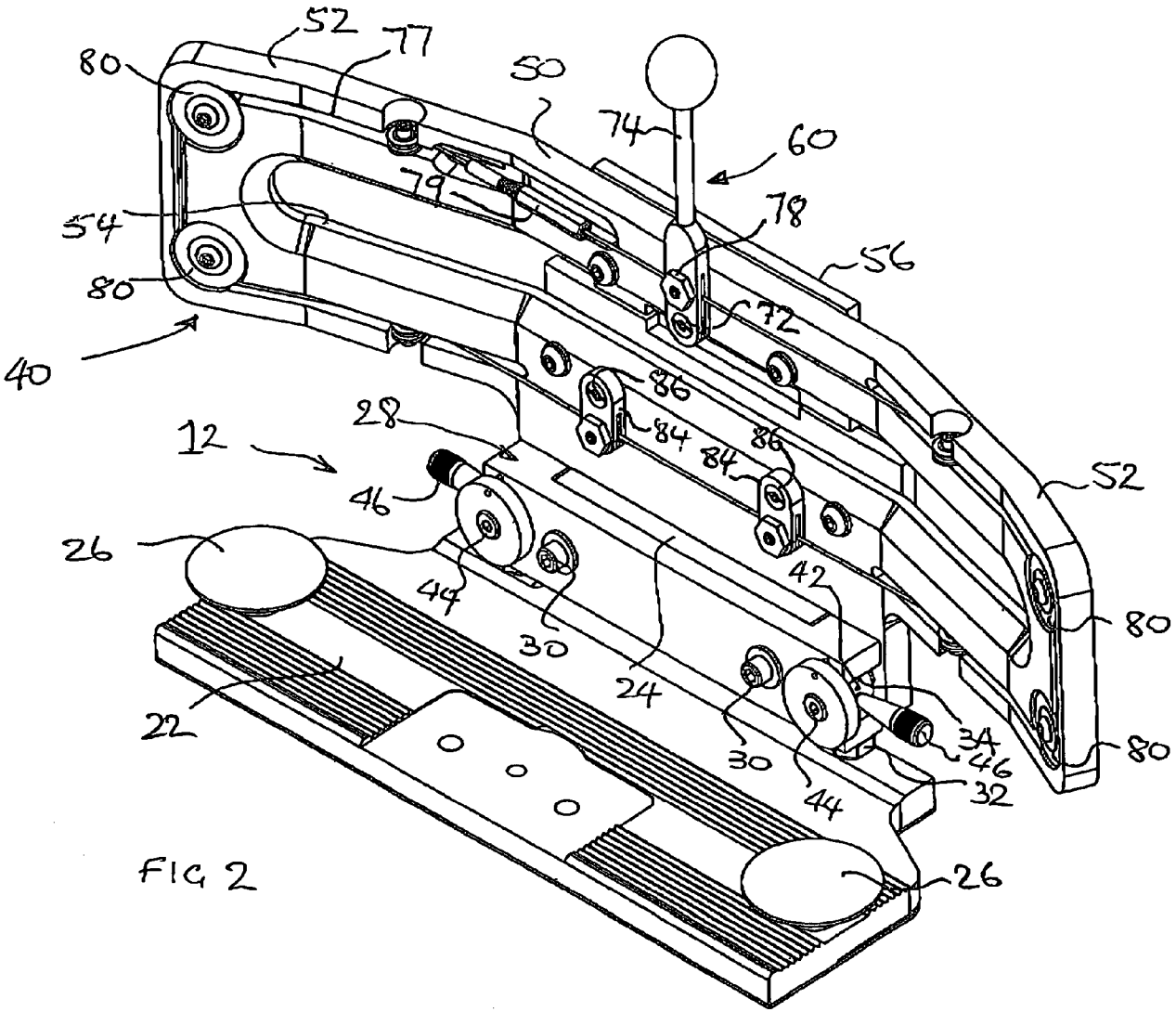
FIG. 2 is a perspective view of the skate holder of FIG. 1.
Figure 3:
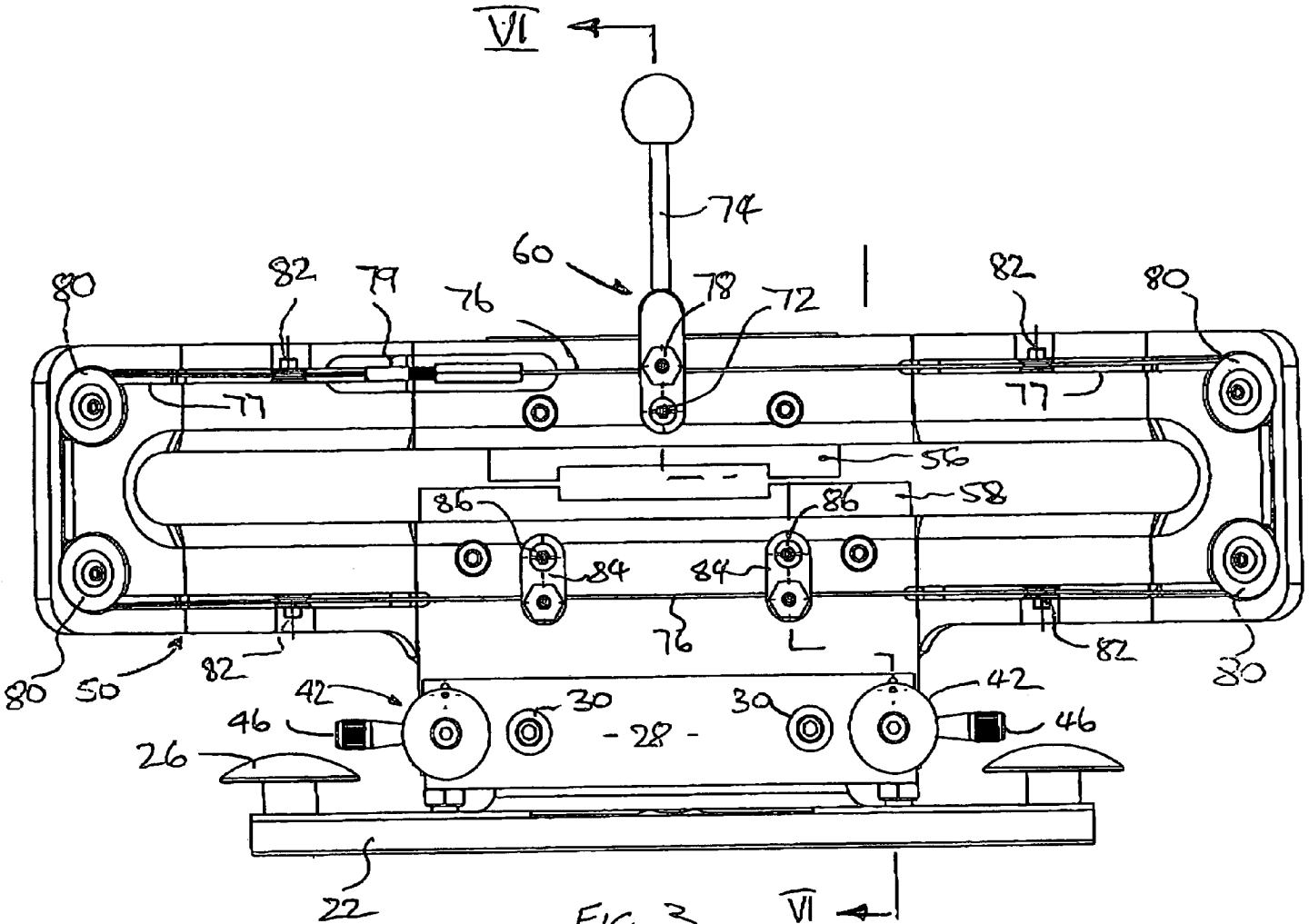
FIG. 3 is a front view of the skate holder shown in FIG. 1.
Figure 4:
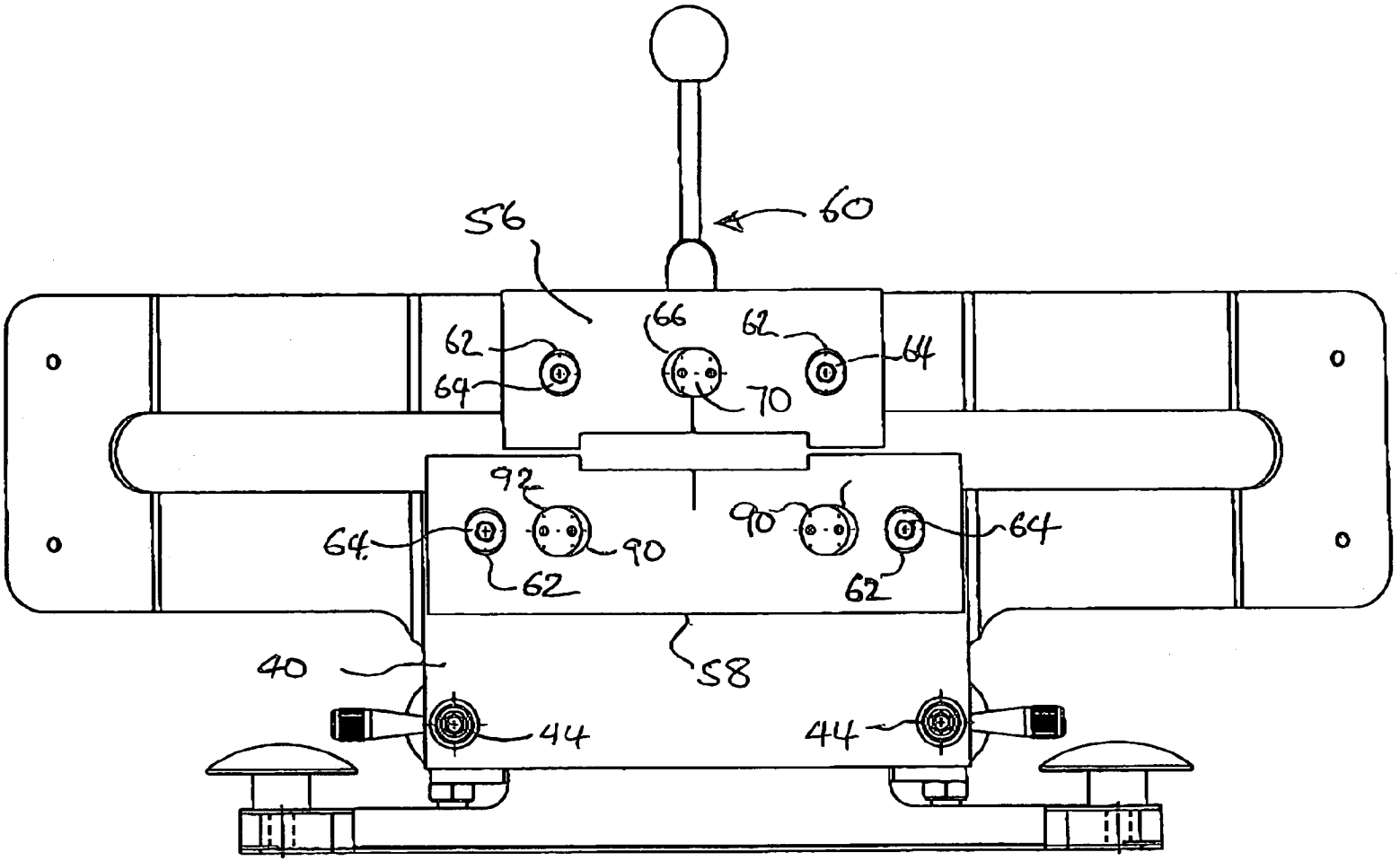
FIG. 4 is a rear view of the skate holder shown in FIG. 1.
Figure 5:
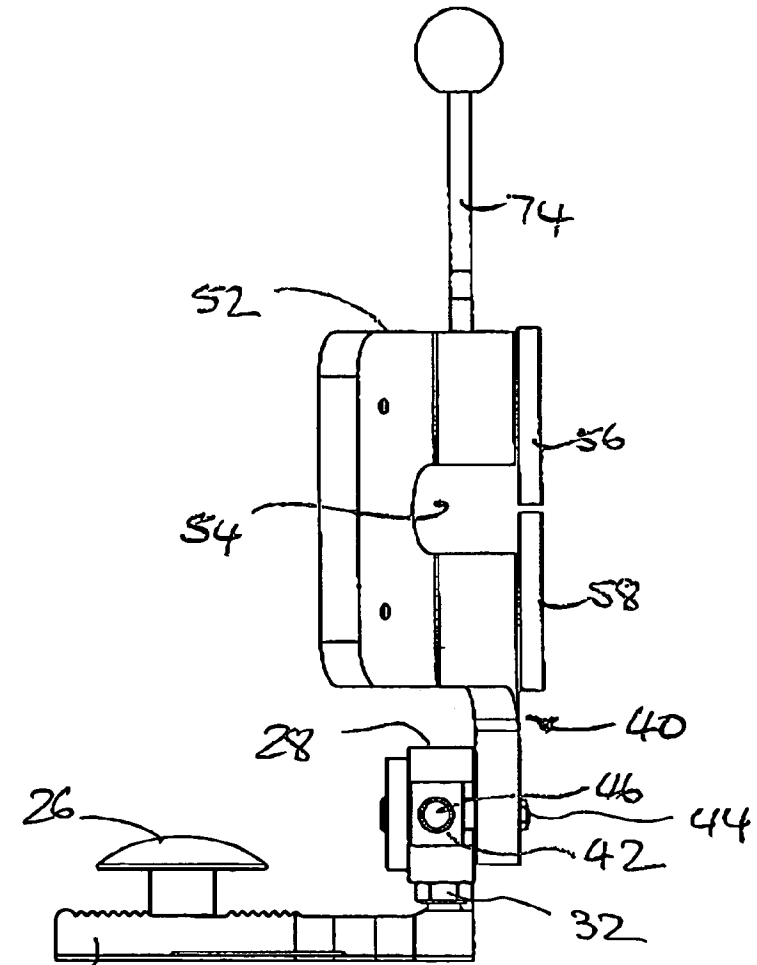
FIG. 5 is an end view of the skate holder shown in FIG. 1.
Figure 6:
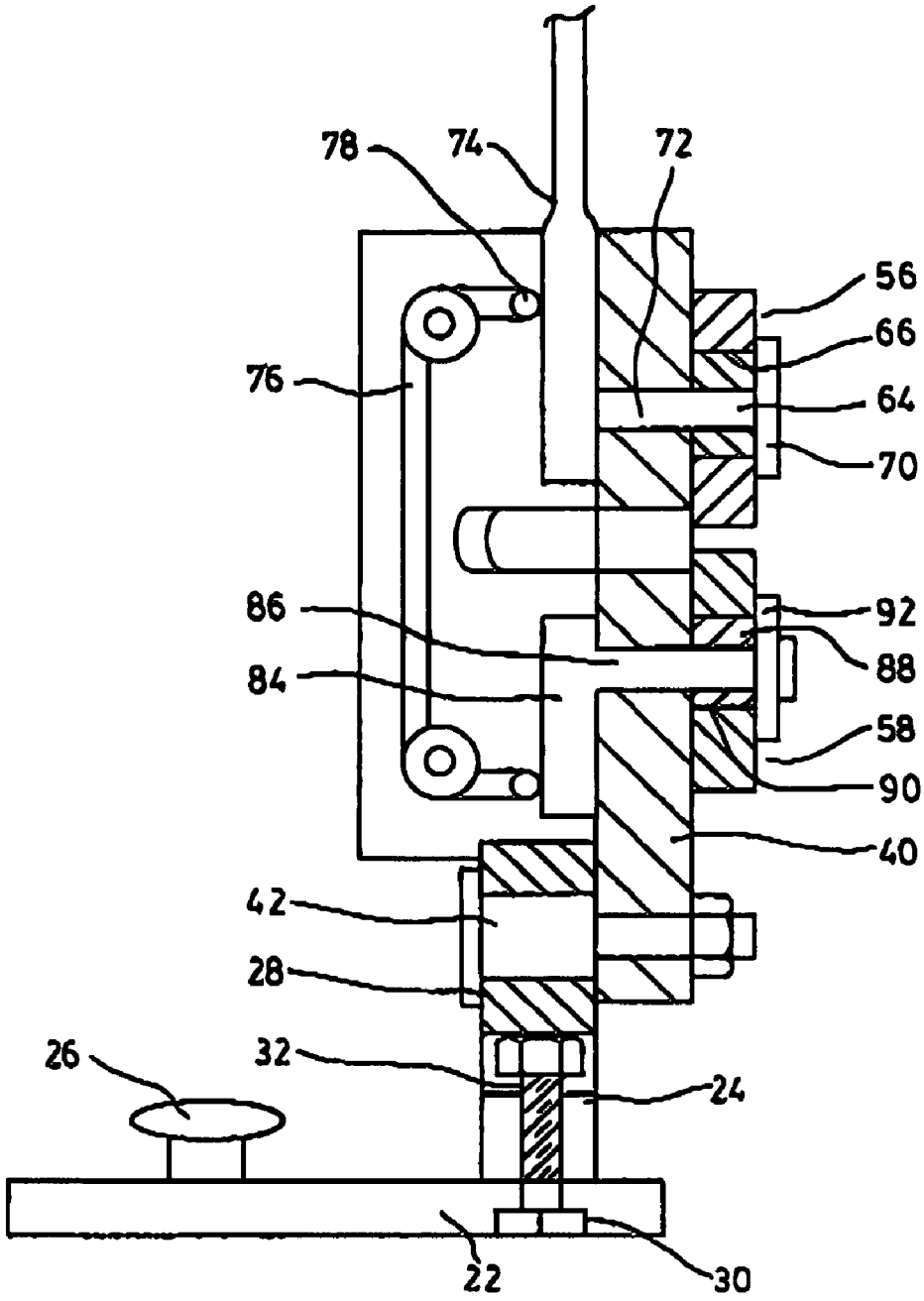
FIG. 6 is a section on the line VI-VI of FIG. 3.
Figure 7:
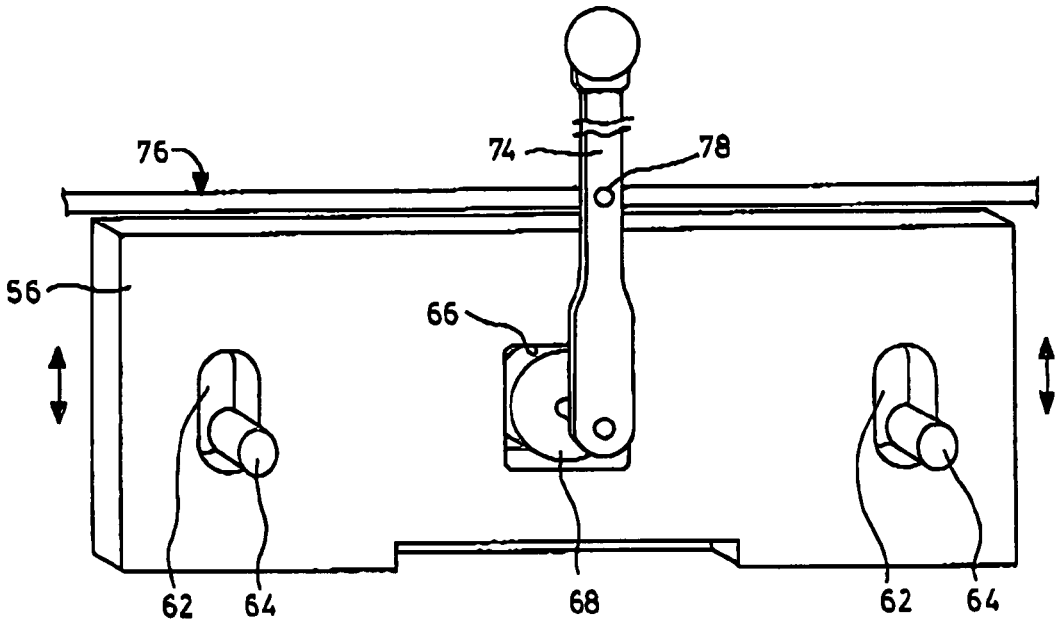
FIG. 7 is an exploded view of a portion of the holder of FIG. 2.
Figure 7:
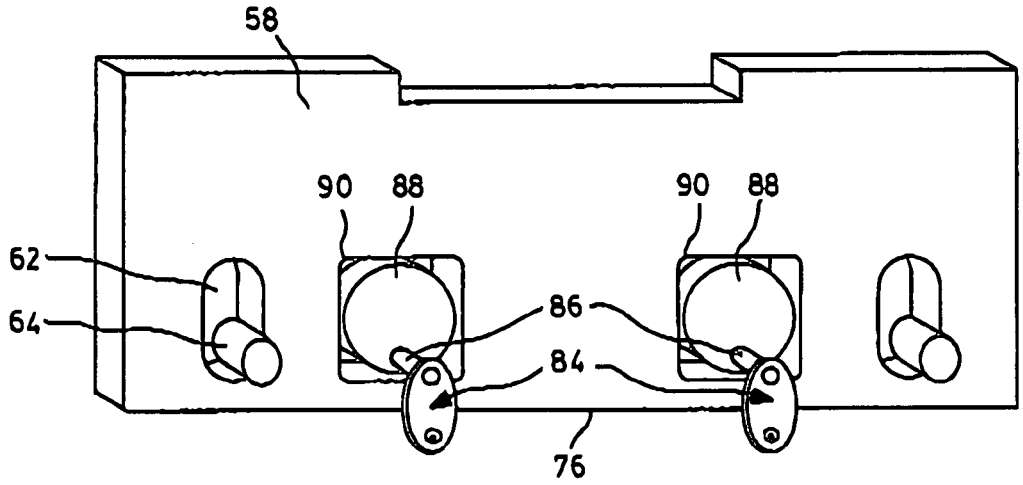
Figure 8:
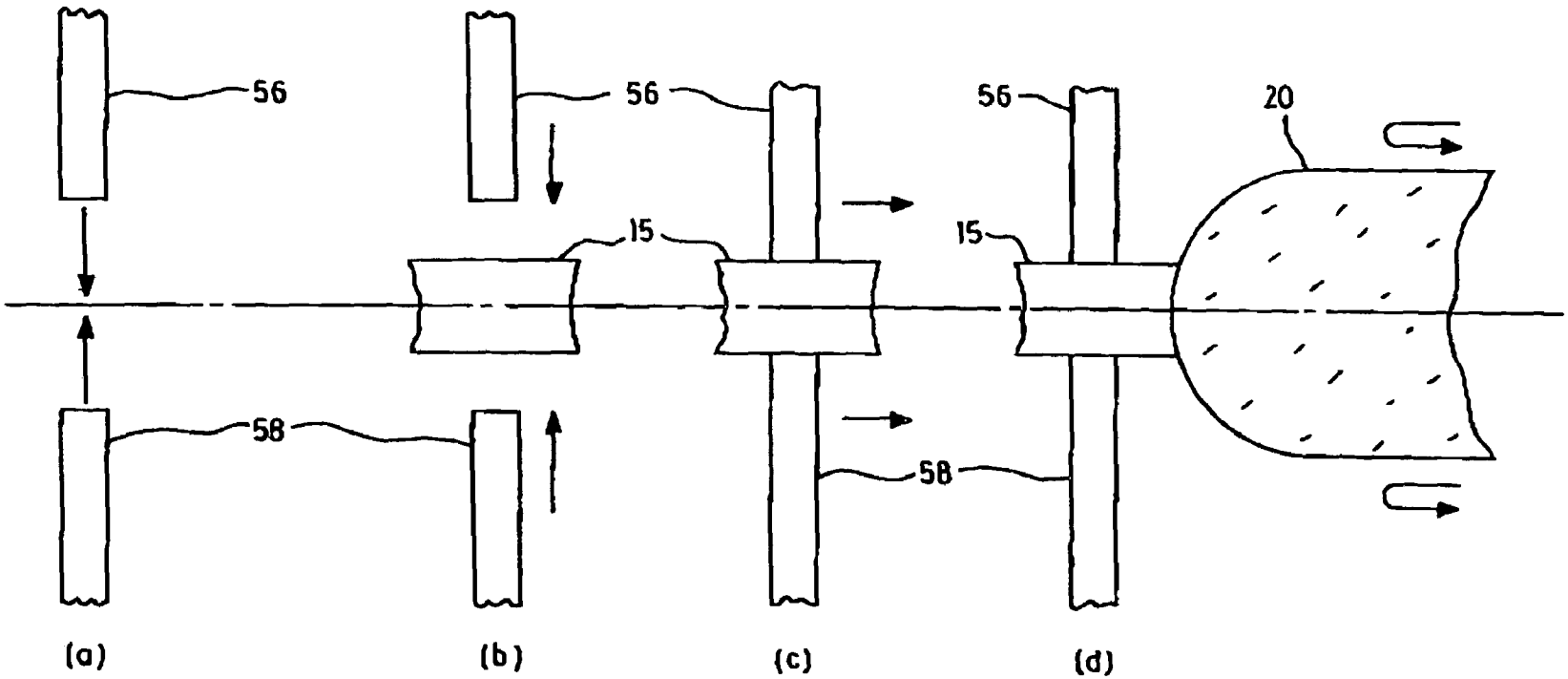

Referring therefore to FIG. 1, a skate sharpening apparatus 10 includes a skate holder 12 that supports a skate 14 having a skate blade 15. The holder 12 is slideable on a work surface 18 so as to be manoeuvrable past a grinder 16 having a grinding wheel 20. The grinding wheel 20 is positioned to rotate about a vertical axis in a horizontal plane and, upon engagement with the blade 15, to grind the requisite profile.

The details of the holder 15 can be seen in more detail in FIGS. 2 through 7. The holder 12 has a base 22. A pair of handles 26 are provided on the base 22 to facilitate manipulation of the holder 12 on the worktop 18. A mounting block 28 is secured to an upturned lip 24 of the base 22 by bolts 30. The position of the mounting block 28 relative to the base is adjusted by means of set screws 32 which are threaded into the base 22 and bear against the underside of the mounting block 28. The set screws 32 provide a nominal or coarse adjustment for the disposition of the mounting block 28 relative to the base 22 to ensure alignment between the holder 12 and the base 22.

The mounting block 28, has an open ended slot 34 at each end in which a pair of cam members 42 are mounted. Each of the cam members 42 are mounted on threaded pivot bolts 44 secured to the lower edge of a mounting plate 40. The cam members 42 provide an outer surface that is eccentric to the bolts 44 and have a radial handle 46. The cam member 42 is dimension to be a close fit within the slot 34 such that rotation of the cam member 42 on the bolts 44 provides relative vertical adjustment between the plate 40 and the mounting block 28. This arrangement provides a fine alignment of the plate 40 relative to the base 22 with the locking bolts 30 clamping plate 40 to the mounting block 28 after the required alignment has been achieved, The plate 40 has a planar central portion 50 and curved end portions 52. An elongate slot 54 extends through the central portion 50 into each of the end portions 52 and is dimensioned to receive the blade 15 of a skate with adequate clearance to accommodate different sizes and thicknesses. A pair of jaws 56, 58 are slideably mounted on the central portion 50 and are moveable by an operating mechanism 60 between an open position in which the slot 54 is relatively unencumbered and a closed potion in which the jaws 56, 58 engage the skate blade 15. Referring again to FIGS. 4 to 7, the jaws 56, 58 each have a pair of slots 62 that receive a guide pin 64 secured to the mounting plate 40. The guide pin 64 is a sliding fit within the slot 62 and therefore constrains the jaws 56,58 for movement in a direction perpendicular to the axis of the slot 54.

The upper jaw 56 has a follower recess 66 formed between the slots 62 to receive a cam 68. The cam 68 is a close fit within the recess 66 and is secured by a retainer 70 to an actuator spindle 72 for rotation with the spindle 72. The spindle 72 is rotatably mounted in the support plate 40 and is secured at its opposite end to a lever 74.

The lever 74, which forms part of the operating mechanism 60, has a cable 76 secured to it by a fastener 78 at a location spaced from the spindle 72. The cable 76 is entrained within a recess 77 extending around the periphery of the plate 40 by a set of guide pulleys 80 each of which is rotatably secured to one of the end portions 52 adjacent to corners of the guide plate 40. The cable 76 also runs through slides 82 positioned between the pulleys 80 and jaws 56, 58 to cause the cable 76 to conform generally to the curvature of the end portions 52. The length of cable 76 may be adjusted by a threaded connector 79 so that the cable is taut around the pulleys 80.

The cable 76 is attached on its lower run to a pair of actuating arms 84, each of which is secured to respective spindles 86. The spindles 86 extend through the mounting plate 40 and are connected to respective ones of a pair of cams 88. The cams 88 are located within respective follower recesses 90 in the lower jaw 58, similar to the recess 66, and the jaw 58 is retained by a retainer 92 secured to the spindle 86 to ensure the cams 88 rotate with the spindles 86.

In operation, the mounting plate 40 is adjusted relative to the base 22 using the mounting block 28 such that the longitudinal axis of the slot 54, which acts as a datum, is aligned with the plane of the grinding wheel 20 and is positioned on the center line of the wheel 20. The skate blade 15 is then inserted into the slot 54 and the handle 74 rotated to move the jaws 56, 58 into engagement with the blade 15. As the handle 74 is rotated, the cam 66 is likewise rotated and causes the jaw 56 to move inwardly toward the blade 15. The movement of the handle 74 is also transmitted through the cable 76 to each of the actuating arms 84. The spindles 86 are thus rotated causing the cam 88 to cause a corresponding displacement of the jaw 58 toward the blade 15. The jaws 56, 58 are thus brought into engagement with the blade 15 so that the blade 15 is held securely between the jaws and in alignment with the wheel 20.

It will be apparent that the attachment points of the cable 76 to the handle 74 and the actuating arms 84 are chosen such that an equal and opposite displacement of the jaws 56, 58 is obtained. This ensures that the blade 15 is maintained on the center line of the slot 54 in alignment with the wheel 20 as the jaws are moved into the clamping position. Accordingly, different thicknesses of blade can be accommodated without adjusting the disposition of the slot relative to the plane of the wheel 20.

With the blade 15 secured, the base 22 can be manipulated to bring the blade into engagement with the wheel 20 and grind the required profile onto the edge of the blade 15. After the grinding is complete, the handle 74 is simply rotated in the opposite direction to release the jaws 56, 58 and permit removal of the blade. It will be noted that the operating system 60 is contained on the plate 40 and thus allows unencumbered access to the skate during sharpening.

The eccentricity of the cams is selected such that, over the typical range of blade thicknesses, the engagement between the cams and the respective recesses is essentially self locking. Thus, after the handle 74 is moved to bring the jaws into the clamping position, the handle may be released and the jaws will remain engaged with the blade.

It is found that the entrainment of the cable 76 over the pullies ensures a free movement of the cable to ensure that conjoint movement of the cam members is obtained. Whilst the routing of the wire within a sheath might also be used, it is believed that the entrainment around the pullies inhibits potential binding with the sheath.

It will of course be appreciated that the handle 74 may be separated from the actuation of the cam so that the handle may be at either end of the support plate 40 and operate the cam through an arm similar to that used on the lower jaw 58.

In certain circumstances the forces applied to the jaws 56, 58 through the operating mechanism 60 may be sufficient to deflect the upper portion of the mounting plate 50 which in turn could result in the blade not being exactly centered. A further embodiment of mounting plate is shown in FIG. 9 in which like components will be shown with like reference numerals with a suffix a added for clarity.

Figure 9:
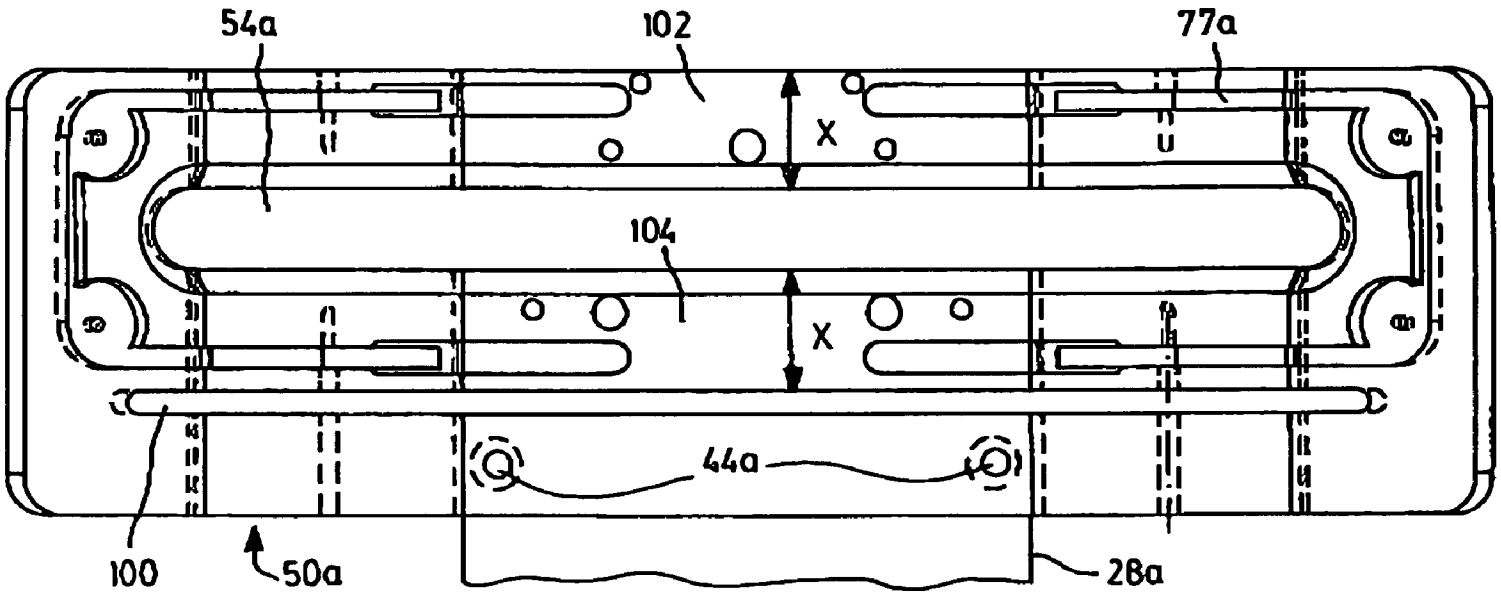
FIG. 9 is a front view of a further embodiment of a component used in the skate holder of FIG. 1.

Referring therefore to FIG. 9, a mounting plate 50*a* has a central slot 54*a* and a peripheral groove 77*a*. It will be understood that the operating mechanism and jaw are mounted on the mounting plate 50*a* in a manner similar to that described above. Similarly, the plate 50*a* may be secured to a mounting block 28*a* by bolts 44*a* located on the lower edge of the plate 54*a*.

An elongate slit 100 is formed on the opposite side of the recess 77*a* to the slot 54*a*. The slit 100 is placed above the block 28*a* and extends parallel to and over substantially the same length as the slot 54*a*. The slit 100 is spaced from the lower edge of the slot 54*a* by a distance (indicated 'x') corresponding to the spacing of the upper edge of the slot 54*a* from the top edge of plate 54*a*.

The provision of the slit 100 and its placement relative to the lower edge of the slot 54*a* provides a pair of beams 102, 104 of substantially similar dimensions that support the operating mechanism 60. The forces induced by the engagement of the jaws 56*a*, 58*a* with the blade are thus reacted by a similarly dimensioned support and the deflection of each of the supports is similar. Thus, the blade remains centered within the slot and variations in the load supplied through the cam mechanism to the jaws will cause equal and opposite displacement of the support portions of the plate 50*a* to maintain the required alignment.

Figure 10:
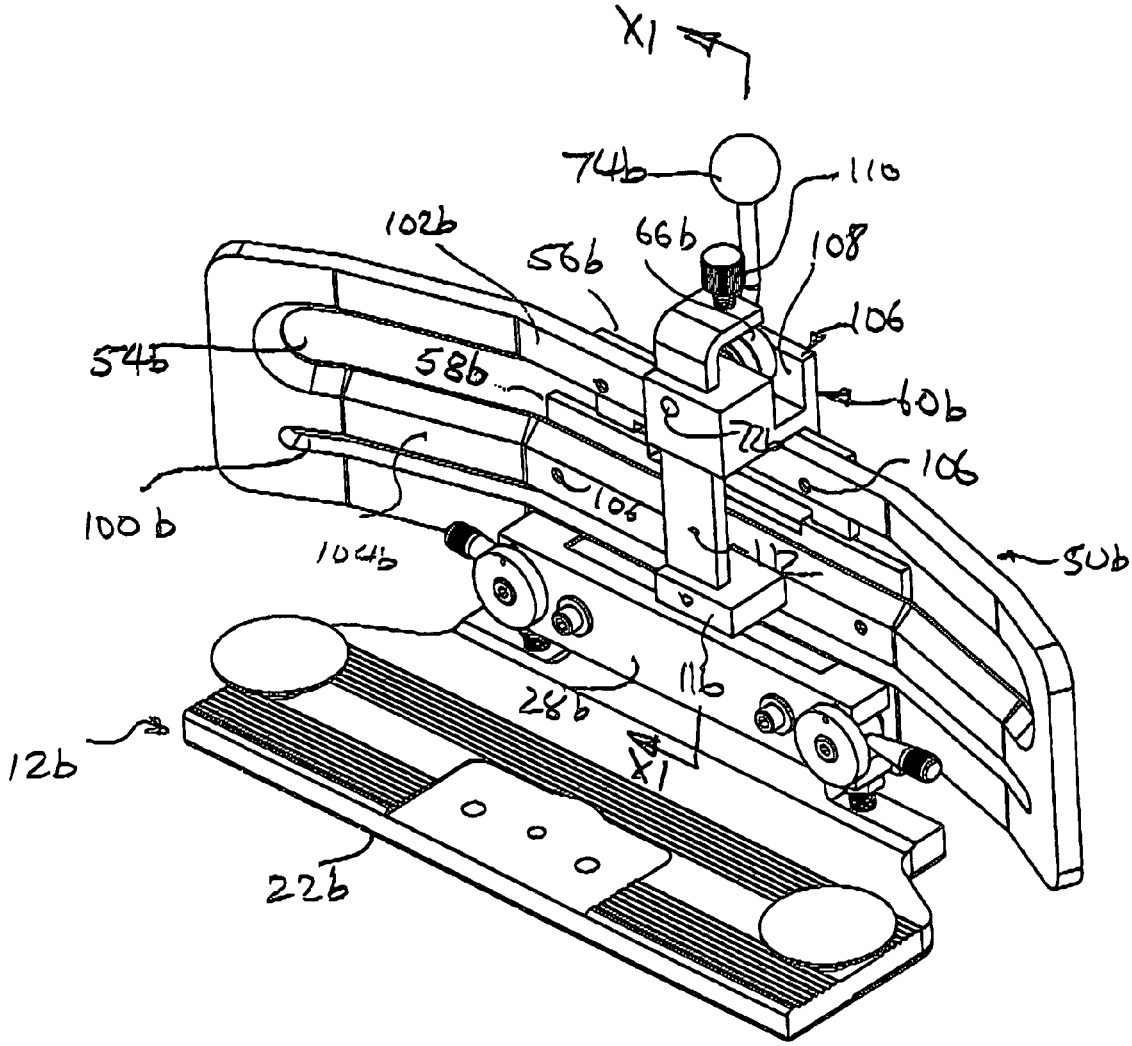
FIG. 10 is a perspective view of an alternative embodiment of a skate holder.
Figure 11:
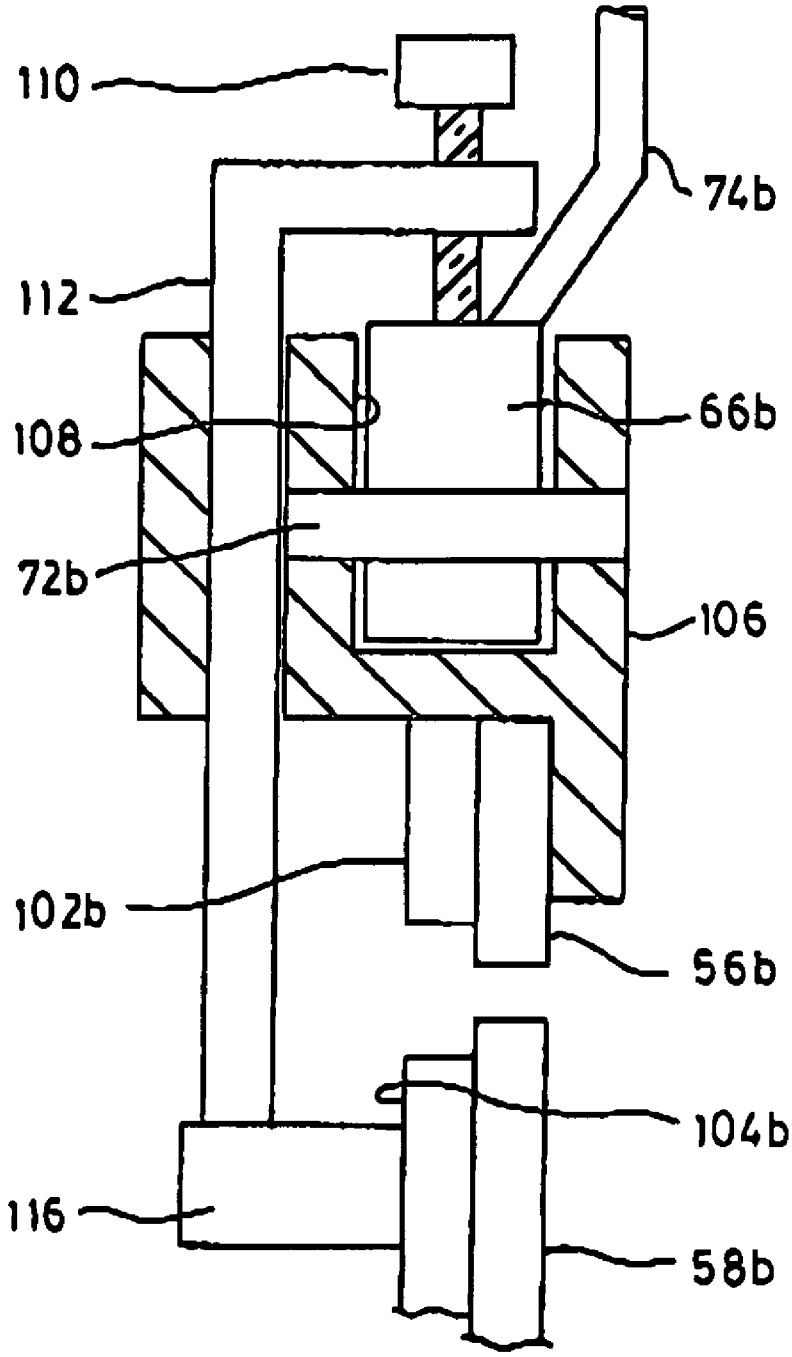
FIG. 11 is a view on the line XI-XI of FIG. 10.

In the above embodiments shown in FIGS. 1 through 9, the skate holder 12 may accommodate blades of different configurations but may be either solid or with cut outs. However, a substantial number of blades intended for ice hockey use are provided with the central portion of the blade removed which provides the opportunity for a simpler clamping mechanism as shown in FIGS. 10 and 11. In the embodiment of FIGS. 10 and 11, like components will be identified with like reference numerals with a suffix b added for clarity.

Referring therefore to FIG. 10, the skate holder 12*b* has a mounting block 28*b* on which is supported a mounting plate 50*b*. The mounting plate 50*b* has an elongate slot 54*b* and a parallel spaced slit 100*b* as described above with respect to FIG. 9. Adjustment of the mounting plate 54*b* relative to the base 22*b* is accomplished as described above with respect to FIGS. 1 through 8 so that the slot 54*b* is aligned with the datum as required.

The jaws 56*b*, 58*b* are secured to the upper and lower beams 102*b*, 104*b* by set screws 106. The jaws 56*b*, 58*b* are thus fixed to the beams for movement with them The operating mechanism 60*b* includes a yolk 106 secured to the upper beam 102*b*. The yolk has a channel 108 with a cam 66*b* mounted within the channel 108 for rotation on the pivot 72*b*. A handle 74*b* is secured to the pivot 72*b* to effect rotation of the cam within the channel 108 and the cam 66*b* is aligned with the beam 102*b*.

A follower 110 engages the surface of the cam 66*b* and is supported in a bar 112. The bar 112 is slidably supported in the yolk 106 with the terminal portion extending across the channel 108. The follower 110 is threaded into the terminal portion 114 so that it may be adjusted relative to the cam 66*b*.

The lower end 115 of the bar 112 is secured to a block 116 mounted on the beam 104*b*. In operation, the blade is inserted between the jaws 56*b*, 58*b* with the bar 112 removed. The bar is then inserted into the blocks 116 and yolk 106 and secured to the block 116. The follower 110 is then adjusted so as to be slightly clear of the cam 66*b* and the handle 74*b* used to rotate the cam 66*b* within the channel 108. The eccentricity of the cam 66*b* causes the bar 112 to be displaced and apply a force between the beams 102*b*, 104*b*. As the beams have substantially identical cross section, the deflection of each of the beams is the same and the jaws 56*b*, 58*b* move into engagement with the blade to maintain it on the datum. After sharpening of the blade, the cam 66*b* is released, the bar 112 removed and the skate removed from the slot 54*b*.

The arrangement shown in FIGS. 10 and 11 maintains the jaws 56*b*, 58*b* equally spaced from a datum. The mechanism 60*b* is relatively robust and may readily be used where the configuration of the blade permits the passage of the bar 112. It will also be appreciated that the mounting plates 50*b* can readily be removed and replaced with the alternative configuration of mounting plate such as that shown in FIGS. 1 through 8 or FIG. 9 to allow a full range of blades to be sharpened.

Figure 12:
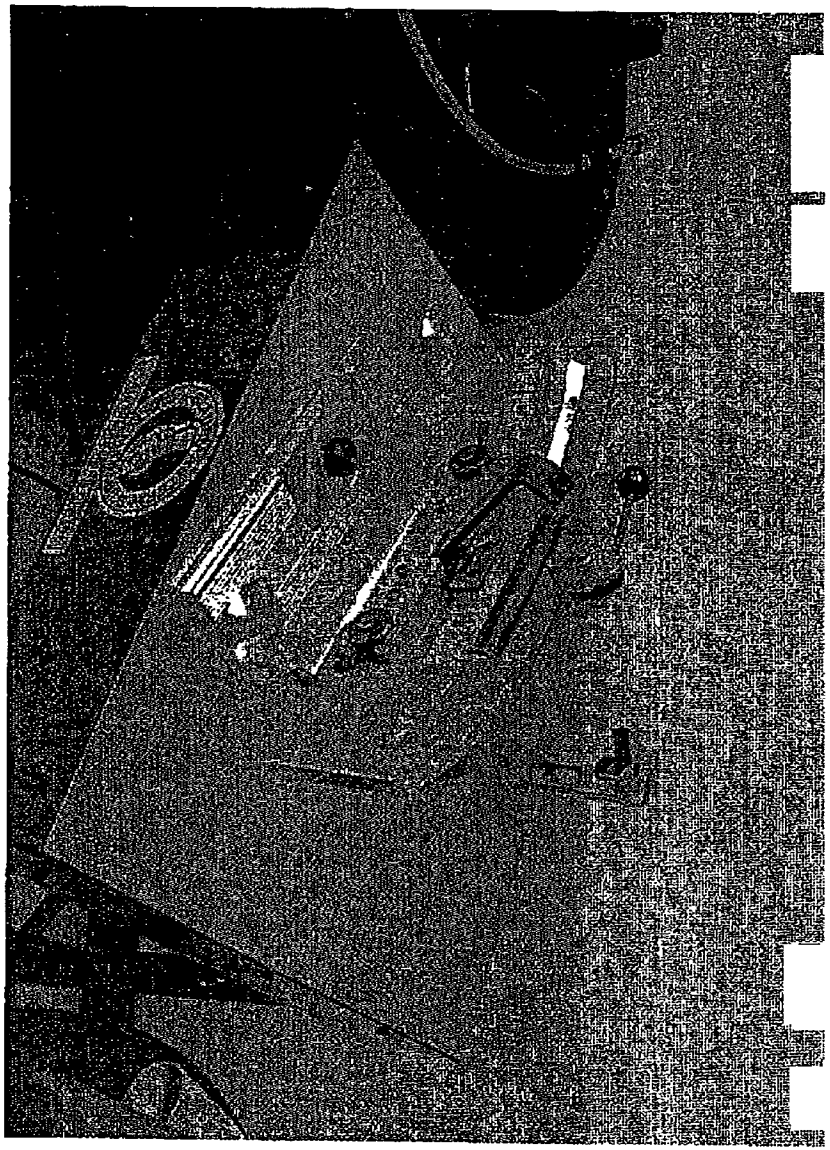
FIG. 12 is a perspective view of a further embodiment of a skate holder.
Figure 14:
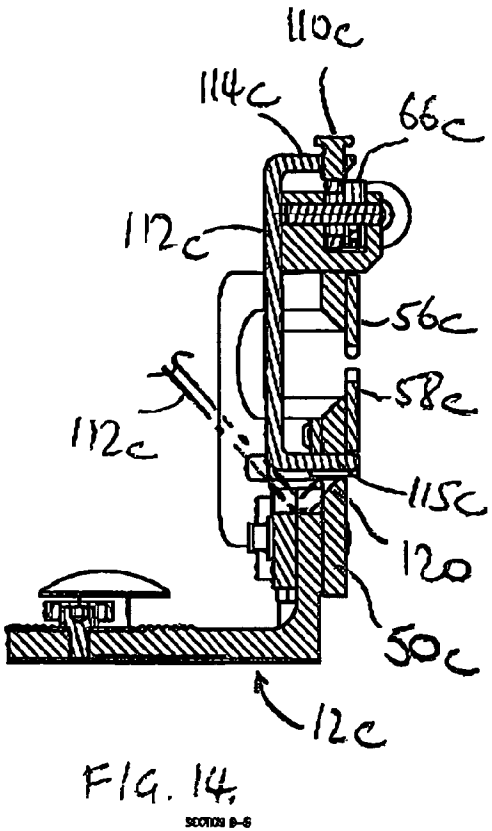
FIG. 14 is a view on the line XIV-XIV of FIG. 13.
Figure 13:
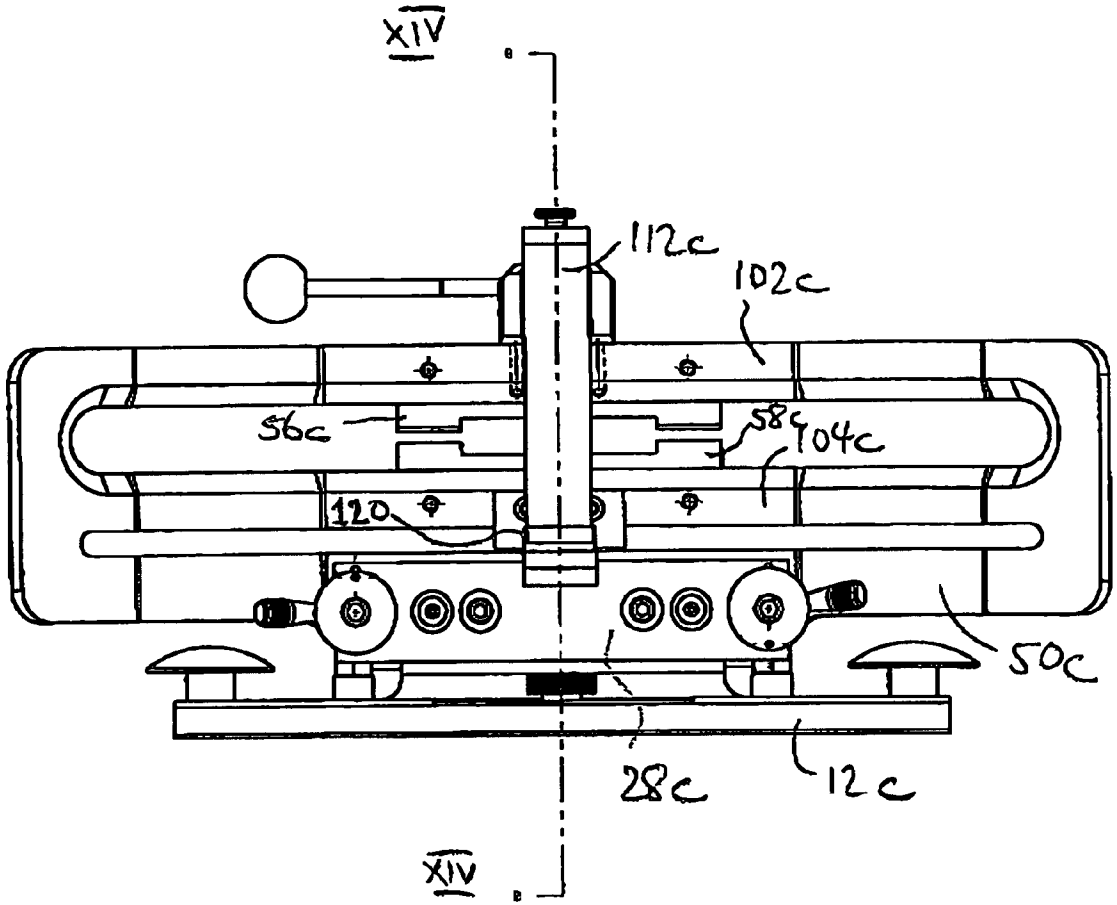
FIG. 13 is a front elevation of the skate holder of FIG. 12.

A further embodiment of the skate holder is shown in FIGS. 12 to 14. The skate holder is a modification of that shown in FIGS. 10 and 11 and like reference numerals will be used to denote like components with a suffix 'c' added for clarity. Referring therefore to FIGS. 12 to 14, the skate holder 12*c* has a mounting block 28*c* with a mounting plate 50*c* secured to it. Jaws 56*c*, 58*c* are secured to the beams 102*c*, 104*c* and an operating mechanism 60*c* similar to that shown in FIGS. 10 and 11 operates on a bar 112*c* to close the jaws 56*c*, 58*c*. The bar 112*c* has a terminal portion 114*c* with follower 110*c* engaging the cam 66*c*.

The lower end 115*c* of the bar 112*c* projects inwardly to be received beneath the beam 104*c*. The loads applied by the operating mechanism are thus applied in the same plane as jaws 56*c*, 58*c* to inhibit twisting of the beams 102*c*, 104*c*.

It will also be noted from FIG. 14 that the mounting plate 50*c* is relieved to provide an inclined notch 120 in the vicinity of the lower end 115*c*. The notch 120 permits the bar 112*c* to pivot relative to the mounting plate 50*c*, as shown in ghosted outline and in FIG. 12 to facilitate placement and removal of the skate blade.

With the bar 112*c* pivoted to the open position, the blade can be fed over the bar 112*c* and between the jaws 56*c*, 58*c*. The bar 112*c* is then pivoted to the closed position and the follower 110*c* engaged with the cam 66*c*. The cam 66*c* is rotated to draw the jaws 56*c*, 58*c* toward one another and clamp the blade at the required height. When sharpening is complete, the bar 112*c* is again released and the blade removed.

The invention claimed is:

1. A skate holder for clamping the blade of a skate comprising a base; a mounting plate secured to said base, said mounting plate having an elongated slot therein to receive said blade and a pair of flexible beams disposed on opposite sides of said slot; a pair of jaws each being located on a respective one of said flexible beams on opposite sides of said slot and being moveable relative to one another to engage opposite sides of said blade; and an operating mechanism connected to each of said jaws and being operable to move said jaws conjointly from an open position to a closed position by flexing said beams towards one another; whereby said jaws remain equally spaced to opposite sides of a datum during movement thereof.

2. A skate holder according to claim 1 wherein said operating mechanism is supported on said mounting plate.

3. A skate holder according to claim 2 wherein said operating mechanism includes a tie bar that extends across said slot to transfer a force applied to one side of said slot to the opposite side thereof for flexing said beams.

4. A skate holder according to claim 3 wherein said force is applied by a cam member acting between said one side and said tie bar.

5. A skate holder according to claim 4 wherein said cam member is rotatably secured to said one side and a follower engages said cam member to transmit said force to said tie bar.

6. A skate holder according to claim 1 wherein said beams have a similar stiffness in bending such that a force applied to each of said beams produces a substantially equal deflection of each beam.

7. A skate holder according to claim 1 wherein at least one of said flexible beams is formed in said mounting plate between said slot and a slit disposed between said slot and an edge of said mounting plate.

8. A skate holder according to claim 1 wherein said jaws are secured to said beams for movement therewith and said operating mechanism induces equal and opposite deflection of said beams.

9. A skate holder according to claim 8 wherein a bar extends between said beams and a cam mechanism acts between said bar and one of said beams to apply a load to each of said beams.

10. A skate holder according to claim 9 wherein said bar is mounted for pivotal movement relative to another of said beams to facilitate placement of a blade between said jaws.

11. A skate holder according to claim 9 wherein said cam mechanism and said bar are connected to respective beams to apply a load in substantially the same plane as said beams.

12. A skate holder according to claim 7 wherein one of said beams is defined between said edge and said slot and the other of said beams is defined between said slot and said slit.

13. A skate holder according to claim 1 wherein said mounting plate has a planar central portion and end portions which are twined with repeat to said central portion.

* * * * *